US006190129B1

(12) United States Patent
Mayer et al.

(10) Patent No.: US 6,190,129 B1
(45) Date of Patent: Feb. 20, 2001

(54) TAPERED TIP-RIB TURBINE BLADE

(75) Inventors: Jeffrey C. Mayer, Swampscott; Gary C. Liotta, Beverly, both of MA (US); John H. Starkweather, Cincinnati, OH (US); Antonio C. Gominho, Andover, MA (US)

(73) Assignee: General Electric Company, Cincinnati, OH (US)

( * ) Notice: Under 35 U.S.C. 154(b), the term of this patent shall be extended for 0 days.

(21) Appl. No.: 09/217,659

(22) Filed: Dec. 21, 1998

(51) Int. Cl.[7] ..... B63H 1/14
(52) U.S. Cl. ..... 416/97 R; 416/92; 416/235
(58) Field of Search ..... 416/92, 97 R, 416/97 A, 96 A, 236 A, 228, 235; 415/115, 116, 173.1, 173.2, 173.5

(56) References Cited

U.S. PATENT DOCUMENTS

| | | | |
|---|---|---|---|
| 3,778,183 | 12/1973 | Luscher et al. . | |
| 3,899,267 | 8/1975 | Dennis et al. . | |
| 4,142,824 | 3/1979 | Andersen . | |
| 4,424,001 | 1/1984 | North et al. . | |
| 4,893,987 | 1/1990 | Lee et al. . | |
| 5,122,033 | 6/1992 | Paul . | |
| 5,261,789 | 11/1993 | Butts et al. . | |
| 5,348,446 | 9/1994 | Lee et al. . | |
| 5,370,499 | 12/1994 | Lee . | |
| 5,403,158 | 4/1995 | Auxier . | |
| 5,476,363 | 12/1995 | Freling et al. . | |
| 5,476,364 | 12/1995 | Kildea . | |
| 5,564,902 | 10/1996 | Tomita . | |
| 5,660,523 | 8/1997 | Lee . | |
| 6,039,531 * | 3/2000 | Suenaga et al. | 415/115 |
| 6,059,530 * | 5/2000 | Lee et al. | 416/97 R |

FOREIGN PATENT DOCUMENTS

2155558 * 3/1984 (GB) ..... 415/173.1

OTHER PUBLICATIONS

U.S. application No. 09/323,375, filed Jun. 1, 1999, entitled "Turbine Blade Tip with Offset Squealer," filed by General Electric Company.

Ching–Pang Lee, "Tapered Tip Turbine Blade," U.S. application No. 09/217 105, filed Dec. 21, 1998 (GE Docket No. 10827).

* cited by examiner

*Primary Examiner*—Edward K. Look
*Assistant Examiner*—Hermes Rodriguez
(74) *Attorney, Agent, or Firm*—Andrew C. Hess; Rodney M. Young

(57) ABSTRACT

A gas turbine engine rotor blade 18 includes a dovetail 22 and integral airfoil 24. The airfoil includes a pair of sidewalls 28,30 extending between leading and trailing edges 32,34, and longitudinally between a root 36 and tip 38. The sidewalls are spaced laterally apart to define a flow channel 40 for channeling cooling air through the airfoil. The tip includes a floor 48 atop the flow channel, and a pair of ribs 50,52 laterally offset from respective sidewalls. The ribs are longitudinally tapered for increasing cooling conduction thereof.

18 Claims, 3 Drawing Sheets

TAPERED TIP-RIB TURBINE BLADE

The Government has rights to this invention pursuant to Contract No N00421-97-C-1232, awarded by the Department of the Navy.

BACKGROUND OF THE INVENTION

The present invention relates generally to gas turbine engines, and, more specifically, to turbine blade cooling.

In a gas turbine engine, air is pressurized in a compressor and mixed with fuel in a combustor to generate hot combustion gases which flow downstream through one or more turbines which extract energy therefrom. A turbine includes a row of circumferentially spaced apart rotor blades extending radially outwardly from a supporting rotor disk. Each blade typically includes a dovetail which permits assembly and disassembly of the blade in a corresponding dovetail slot in the rotor disk. An airfoil extends radially outwardly from the dovetail.

The airfoil has a generally concave pressure side and generally convex suction side extending axially between corresponding leading and trailing edges and radially between a root and a tip. The blade tip is spaced closely to a radially outer turbine shroud for minimizing leakage therebetween of the combustion gases flowing downstream between the turbine blades. Maximum efficiency of the engine is obtained by minimizing the tip clearance or gap, but is limited by the differential thermal expansion and contraction between the rotor blades and the turbine shroud for reducing the likelihood of undesirable tip rubs.

Since the turbine blades are bathed in hot combustion gases, they require effective cooling for ensuring a useful life thereof. The blade airfoils are hollow and disposed in flow communication with the compressor for receiving a portion of pressurized air bled therefrom for use in cooling the airfoils. Airfoil cooling is quite sophisticated and may be effected using various forms of internal cooling channels and features, and cooperating cooling holes through the walls of the airfoil for discharging the cooling air.

The airfoil tip is particularly difficult to cool since it is located directly adjacent to the turbine shroud, and the hot combustion gases flow through the tip gap therebetween. A portion of the air channeled inside the airfoil is typically discharged through the tip for cooling thereof. The tip typically includes a radially outwardly projecting edge rib disposed coextensively along the pressure and suction sides between the leading and trailing edges. A tip floor extends between the ribs and encloses the top of the airfoil for containing the cooling air therein, which air increases in temperature as it cools the airfoil, and increases the difficulty of cooling the blade tip.

The tip rib is typically the same thickness as the underlying airfoil sidewalls and provides sacrificial material for withstanding occasional tip rubs with the shroud without damaging the remainder of the tip or plugging the tip holes for ensuring continuity of tip cooling over the life of the blade.

The tip ribs, also referred to as squealer tips, are typically solid and provide a relatively large surface area which is heated by the hot combustion gases. Since they extend above the tip floor they experience limited cooling from the air being channeled inside the airfoil. Typically, the tip rib has a large surface area subject to heating from the combustion gases, and a relatively small area for cooling thereof.

Conventional squealer tips are heated by the combustion gases on both their outboard and inboard sides as well as their top edges as the hot combustion gases flow thereover and through the tip gap. Tip holes placed between the squealer tips continuously purge the hot combustion gases from the tip slot defined therebetween yet are ineffective for preventing circulation of the hot combustion gases therein.

The blade tip therefore operates at a relatively high temperature and thermal stress, and is typically the life limiting point of the entire airfoil.

Accordingly, it is desired to provide a gas turbine engine turbine blade having improved tip cooling.

BRIEF SUMMARY OF THE INVENTION

A gas turbine engine rotor blade includes a dovetail and integral airfoil. The airfoil includes a pair of sidewalls extending between leading and trailing edges, and longitudinally between a root and tip. The sidewalls are spaced laterally apart to define a flow channel for channeling cooling air through the airfoil. The tip includes a floor atop the flow channel, and a pair of ribs laterally offset from respective sidewalls. The ribs are longitudinally tapered for increasing cooling conduction thereof.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
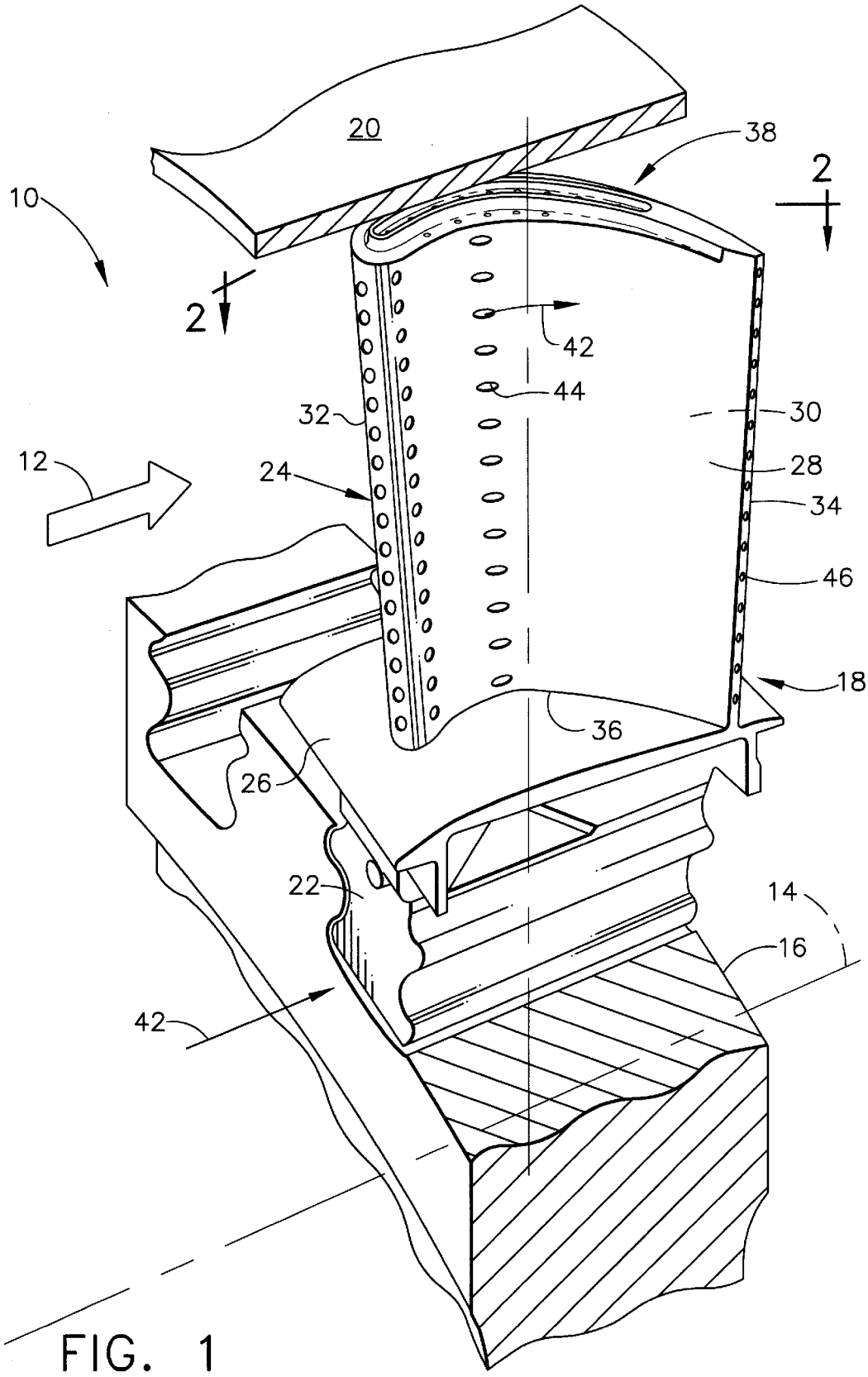
FIG. 1 is a partly sectional, isometric view of an exemplary gas turbine engine turbine rotor blade mounted in a rotor disk within a surrounding shroud, with the blade having a tip in accordance with an exemplary embodiment of the present invention.

Illustrated in FIG. 1 is a portion of a high pressure turbine 10 of a gas turbine engine which is mounted directly downstream from a combustor (not shown) for receiving hot combustion gases 12 therefrom. The turbine is axisymmetrical about an axial centerline axis 14 and includes a rotor disk 16 from which extend radially outwardly a plurality of circumferentially spaced apart turbine rotor blades 18. An annular turbine shroud 20 is suitably joined to a stationary stator casing and surrounds the blades for providing a relatively small clearance or gap therebetween for limiting leakage of the combustion gases therethrough during operation.

Each blade 18 includes a dovetail 22 which may have any conventional form such as an axial dovetail configured for being mounted in a corresponding dovetail slot in the perimeter of the rotor disk 16. A hollow airfoil 24 is integrally joined to the dovetail and extends radially or longitudinally outwardly therefrom. The blade also includes an integral platform 26 disposed at the junction of the airfoil and dovetail for defining a portion of the radially inner flowpath for the combustion gases 12. The blade may be formed in any conventional manner, and is typically a one-piece casting.

The airfoil 24 includes a generally concave, first or pressure sidewall 28 and a circumferentially or laterally opposite, generally convex, second or suction sidewall 30 extending axially or chordally between opposite leading and trailing edges 32,34. The two sidewalls also extend in the radial or longitudinal direction between a radially inner root 36 at the platform 26 and a radially outer tip 38.

Figure 2:
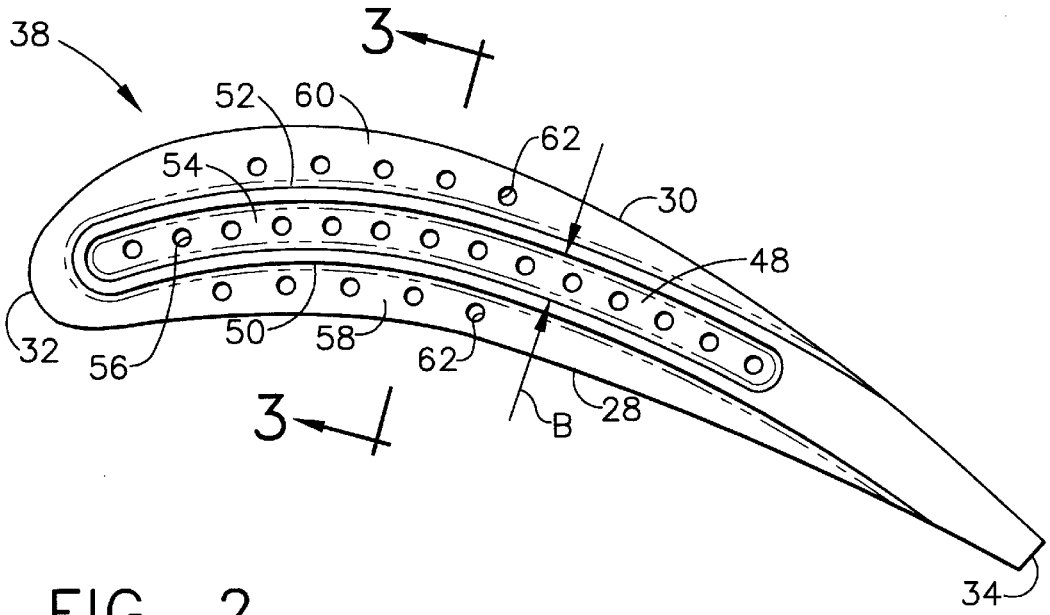
FIG. 2 is a top view of the blade tip illustrated in FIG. 1 and taken along line 2—2.
Figure 3:
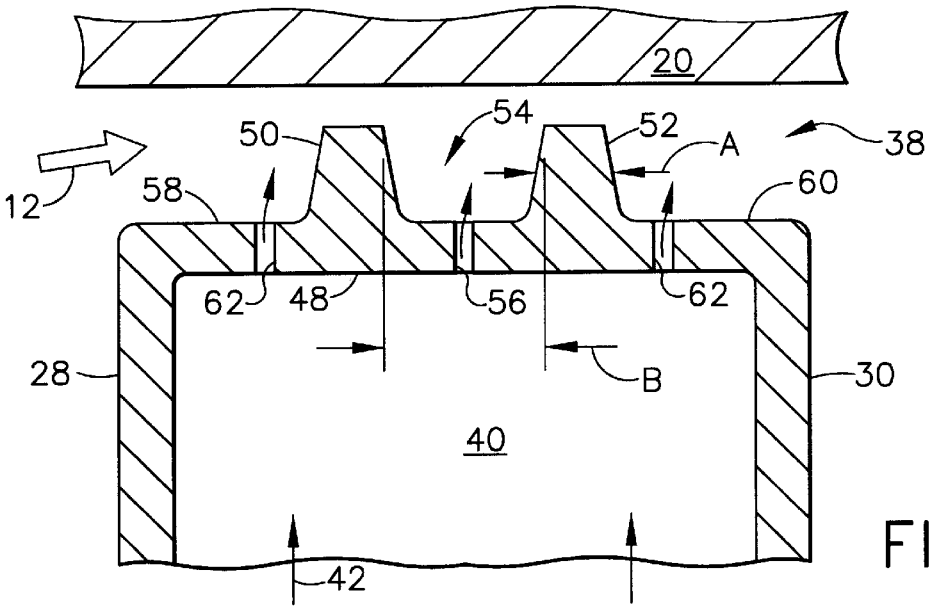
FIG. 3 is an elevational sectional view through the blade tip illustrated in FIG. 2 and taken along line 3—3, and disposed radially within the turbine shroud.

The tip 38 is illustrated in top view in FIG. 2 and in sectional view in FIG. 3, and has a configuration for improving cooling thereof in accordance with an exemplary embodiment of the present invention. As initially shown in FIG. 3, the airfoil first and second sidewalls are spaced apart in the lateral or circumferential direction over the entire longitudinal or radial span of the airfoil to define at least one internal flow channel 40 for channeling cooling air 42 through the airfoil for cooling thereof. The inside of the airfoil may have any conventional configuration including, for example, serpentine flow channels with various turbulators therein for enhancing cooling air effectiveness, with the cooling air being discharged through various holes through the airfoil such as conventional film cooling holes 44 and trailing edge discharge holes 46 as illustrated in FIG. 1.

The trailing edge region of the airfoil may be cooled in any conventional manner by internal cooling circuits therein discharging through the trailing edge cooling holes 46, as well as additional discharge holes at the tip if desired.

As shown in more detail in FIG. 3, the blade tip 38 includes a floor 48 radially atop the flow channel 40 for providing a top enclosure therefor. The tip also includes a pair of first and second ribs 50,52 integrally joined with and extending radially outwardly from the tip floor, and also referred to as squealer tips since they form labyrinth seals with the surrounding shroud 20 and may occasionally rub thereagainst.

The first rib 50 is laterally offset from the first sidewall 28, and, correspondingly the second rib 52 is similarly laterally offset from the second sidewall 30 to position both ribs directly atop the tip floor for improved heat conduction and cooling by the internally channeled cooling air 42.

The placement of both ribs 50,52 directly atop the tip floor and flow channel 40 increases the rate of conduction heat transfer out of the ribs for substantially reducing their temperature under operation in the hot combustion gas environment. Furthermore, the ribs 50,52 are longitudinally or radially tapered for increasing conduction heat transfer area at the tip floor.

In the preferred embodiment, each of the ribs converges outwardly from the tip floor 48 and has a decreasing width A which is maximum at the tip floor and minimum at the radially outermost ends of the ribs 50,52. Each rib is preferably symmetrical in section with opposite radially straight sidewalls which join together at a flat land therebetween.

As shown in FIGS. 2 and 3, the ribs are spaced laterally apart to define a tip channel or slot 54 therebetween and, the tip floor includes a plurality of inboard tip holes 56 extending therethrough in flow communication between the flow channel 40 and the tip slot 54. Since the ribs are laterally offset from the airfoil sidewalls 28,30, the tip slot has a lateral width B which is narrower than if the ribs were disposed directly atop the corresponding sidewalls. The narrower tip slot 54 allows the cooling air 42 to be discharged through the inboard tip holes 56 and more effectively prevent the combustion gases 12 from heating the inboard surfaces of the respective ribs 50,52.

More specifically, the ribs are laterally offset from the corresponding sidewalls to define respective first and second shelves 58,60 which are outboard portions of the tip floor 48 extending inwardly from the respective sidewalls and directly atop the underlying flow channel 40. The tip floor 48 further includes respective pluralities of outboard tip holes 62 which extend therethrough in the respective shelves 58,60. The outboard tip holes 62 are disposed in flow communication with the flow channel 40 for channeling the cooling air therethrough for film cooling the corresponding sides of the respective ribs 50,52. The outboard tip holes are more closely spaced to the respective tip ribs than to the respective sidewalls for protecting the corresponding ribs during operation.

As shown in FIG. 2, the ribs join together at the airfoil trailing edge 34, with the corresponding shelves blending therein in view of the relative thinness of the trailing edge. The ribs also join together adjacent the leading edge 32, with preferably the corresponding shelves 58,60 joining together at the leading edge to offset the ribs away therefrom toward the trailing edge. In this way, the ribs and corresponding shelves wrap around the airfoil leading edge for providing enhanced cooling thereof from the leading edge to substantially the trailing edge, while correspondingly reducing the surface area of the ribs subject to heat influx from the hot combustion gases.

Furthermore, the ribs collectively have a continuous, crescent shaped aerodynamic profile or perimeter as shown in FIG. 2 which extends between the leading and trailing edges 32,34. In the exemplary embodiment illustrated in FIG. 2, the perimeter profile of the ribs corresponds generally with the profile of the corresponding sidewalls 28,30 which are concave and convex, respectively. Although the width B of the tip slot 54 varies along its depth, the slot width B is preferably substantially constant between the leading and trailing edges, with the lateral widths of the tip shelves 58,60 varying to correspondingly position the ribs 50,52. In this way, the tip slot 54 may be correspondingly narrow in width and is more effectively filled with the cooling air discharged from the inboard tip holes 56 to prevent or limit combustion gas recirculation within the tip slot.

Figure 4:
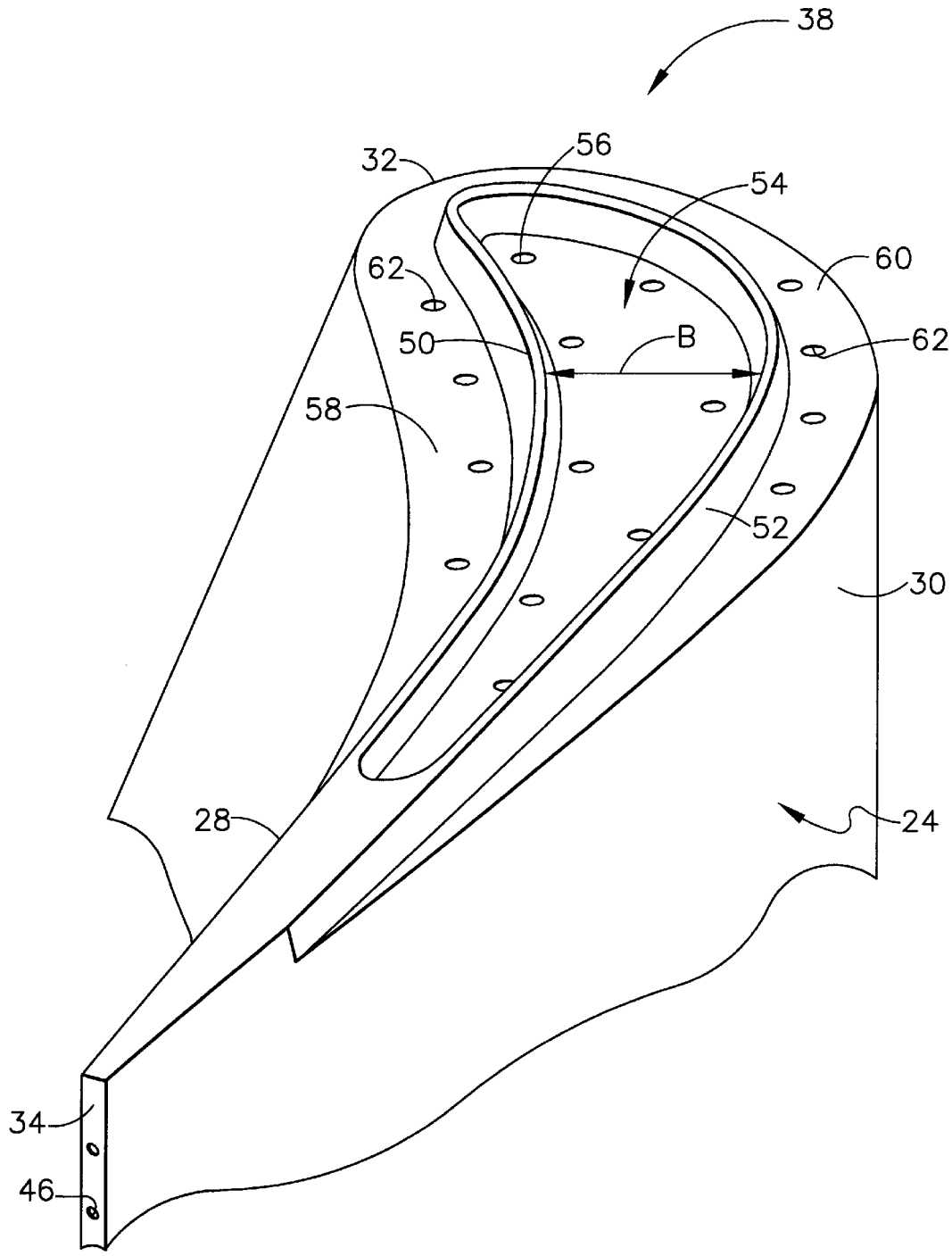
FIG. 4 is an isometric view of the blade tip in accordance with another embodiment of the present invention.

FIG. 4 illustrates an alternate embodiment of the invention wherein the tip slot 54 has a width B which varies between the leading and trailing edges 32,34, and the corresponding tip shelves 58,60 have a substantially constant width so that the outer profile of the ribs substantially matches the aerodynamic outer profile of the concave first sidewall 28 and convex second sidewall 30. In this way, the ability of the airfoil 24 to extract energy from the hot combustion gases is substantially retained even around the offset tip ribs 50,52.

However, the increased aerodynamic performance of the tip ribs 50,52 themselves is at the expense of the varying width tip slot 54 which may permit recirculation of the hot combustion gases therein subject to the amount of cooling air discharged through the inboard tip holes 56. The narrow tip slot 54 in the FIG. 2 embodiment more effectively prevents hot combustion gas recirculation within the tip slot but with an attendant change in aerodynamic efficiency due to the larger tip shelves and reduction in aerodynamic profile of the tip ribs.

Although the tip ribs could vary in width for both matching the aerodynamic profile of the sidewalls and having a substantially constant tip slot, such increased width of the tip ribs is not desired in view of the increased thermal mass thereof and corresponding difficulty in providing effective cooling notwithstanding the present invention.

A particular advantage of the narrow width tip slot illustrated in FIG. 3 is the reduced volume therein between the bounding ribs 50,52 which more effectively collects and distributes the cooling air received from the inboard tip holes 56, and provides a barrier against recirculation of the hot combustion gases therein. In the exemplary embodiment illustrated in FIG. 3, the tip slot 54 is as deep as the corresponding ribs 50,52 are high.

Alternatively, the tip slot 54 may be made even shallower in depth by increasing the thickness of the tip floor between the two ribs. This further decreases the inboard surface area of the two ribs while increasing the available thermal mass therebetween for heat conduction cooling from inside the airfoil.

Analysis of the narrow slot blade tip illustrated in FIG. 3 indicates a substantial reduction in both maximum temperature and bulk temperature of the individual tip ribs as compared with conventional squealer tips extending outwardly from directly above the corresponding airfoil sidewalls. Analysis also indicates a substantial reduction in the thermally induced stress in the tip ribs due to a corresponding reduction in thermal gradients effected therein during operation.

The two-rib blade tip illustrated in FIG. 3 maintains effective labyrinth sealing with the surrounding shroud 20 and more effectively utilizes the discharged cooling air from the tip slot 54 with its attendant small volume.

The tip ribs are also laterally offset around most of the perimeter the airfoil just forwardly of the trailing edge and around both pressure and suction sidewalls as well as at the leading edge. This positions the majority of the tip ribs directly atop the tip floor and the underlying flow channel for improved heat conduction cooling thereof. And, the outboard tip hole 62 may be placed in the available space provided by the corresponding tip shelves for further cooling the respective tip ribs by film cooling.

Accordingly, what is desired to be secured by Letters Patent of the United States is the invention as defined and differentiated in the following claims in which we claim:

1. A gas turbine engine blade comprising:

a dovetail;

an airfoil integrally joined to said dovetail, and including first and second sidewalls extending between leading and trailing edges and longitudinally between a root and tip, and said sidewalls being spaced laterally apart to define a flow channel for channeling cooling air through said airfoil; and said tip includes a floor atop said flow channel, a first rib laterally offset from said first sidewall atop said floor, and a second rib laterally offset from second sidewall atop said floor, and said ribs being longitudinally tapered to converse outwardly from said tip floor, and laterally offset from said sidewalls to define respective shelves thereatop.

2. A blade according to claim 1 wherein:

said ribs are spaced laterally apart to define a tip slot therebetween; and said tip floor includes a plurality of holes extending therethrough in flow communication between said flow channel and said tip slot.

3. A blade according to claim 2 wherein:

said ribs are offset from said first and second sidewalls to define respective first and second shelves atop said flow channel; and said tip floor further includes a plurality of outboard holes extending therethrough at said shelves in flow communication with said flow channel for film cooling said ribs.

4. A blade according to claim 2 wherein said ribs join together adjacent said leading edge, and said shelves join together at said leading edge to offset said ribs away therefrom.

5. A blade according to claim 2 wherein said ribs collectively have a crescent shaped aerodynamic profile extending between said leading and trailing edges.

6. A blade according to claim 5 wherein said profile of said ribs corresponds with a profile of said sidewalls.

7. A blade according to claim 6 wherein:

said tip slot has a substantially constant width between said leading and trailing edges; and said tip shelves vary in width.

8. A blade according to claim 6 wherein:

said tip slot has a varying width between said leading and trailing edges; and said tip shelves have a substantially constant width.

9. A blade according to claim 6 wherein said tip slot is as deep as said ribs are high.

10. A turbine airfoil comprising first and second laterally spaced apart sidewalls extending between leading and trailing edges, and including a tip having a floor extending between said sidewalls and a pair of tapered ribs extending between said leading and trailing edges laterally offset from said sidewalls to define respective shelves therealong, and each of said ribs converges outwardly from said tip floor.

11. An airfoil according to claim 10 wherein said ribs join together adjacent said leading edge, and said shelves wrap around said leading edge at said tip.

12. An airfoil according to claim 11 wherein said ribs join together at said trailing edge, with said shelves blending in thereat.

13. An airfoil according to claim 12 wherein said ribs collectively have a crescent shaped aerodynamic profile extending between said leading and trailing edges.

14. An airfoil according to claim 13 wherein said profile of said ribs corresponds with a profile of said sidewalls.

15. An airfoil according to claim 14 wherein said tip shelves vary in width along said sidewalls.

16. An airfoil according to claim 14 wherein said tip shelves have a substantially constant width along said sidewalls.

17. An airfoil according to claim 14 wherein:

said airfoil includes an internal flow channel;

said tip floor is disposed atop said flow channel; and said ribs are laterally spaced apart to define a tip slot therebetween.

18. An airfoil according to claim 17 wherein said tip floor includes:

a plurality of inboard holes extending therethrough in flow communication between said flow channel and said tip slot; and a plurality of outboard holes extending therethrough in flow communication between said flow channel and said shelves.

* * * * *